United States Patent [19]

Carveth et al.

[11] Patent Number: 4,657,152

[45] Date of Patent: Apr. 14, 1987

[54] THERMOPLASTIC FOAM FITMENT

[75] Inventors: Peter Carveth, Glen Ellyn; Albert Stone, Buffalo Grove; L. Alan White, Gurnee, all of Ill.

[73] Assignee: Baxter Travenol Laboratories, Inc., Deerfield, Ill.

[21] Appl. No.: 802,640

[22] Filed: Nov. 27, 1985

[51] Int. Cl.[4] ..... B65D 41/50

[52] U.S. Cl. ..... 215/249; 604/415

[58] Field of Search ..... 215/247, 248, 249; 604/415, 411

[56] References Cited

U.S. PATENT DOCUMENTS

| | | | |
|---|---|---|---|
| 1,431,871 | 10/1922 | Burnet | 215/247 |
| 3,342,365 | 9/1967 | Lux et al. | 215/1 C X |
| 3,395,261 | 7/1968 | Leatherman et al. . | |
| 3,396,258 | 9/1968 | Leatherman . | |
| 3,461,014 | 9/1969 | James . | |
| 3,462,336 | 9/1969 | Leatherman . | |
| 3,510,619 | 5/1970 | Leatherman . | |
| 3,528,867 | 10/1970 | Leatherman et al. . | |
| 3,652,361 | 3/1972 | Leatherman . | |
| 3,709,775 | 1/1973 | James . | |
| 3,802,985 | 4/1974 | Leatherman . | |
| 3,840,254 | 10/1974 | Shatzkin . | |
| 3,900,360 | 9/1975 | Leatherman . | |
| 3,902,940 | 10/1975 | Heller, Jr. et al. . | |
| 3,923,580 | 12/1975 | Leatherman . | |
| 3,941,641 | 3/1976 | Heller, Jr. et al. . | |
| 3,945,867 | 3/1976 | Heller, Jr. et al. . | |
| 3,994,412 | 11/1976 | Difiglio | 215/249 X |
| 3,996,090 | 12/1976 | Leatherman . | |
| 4,000,760 | 1/1977 | Heller, Jr. et al. . | |
| 4,029,837 | 6/1977 | Leatherman . | |
| 4,035,547 | 7/1977 | Heller, Jr. et al. . | |
| 4,067,765 | 1/1978 | Heller, Jr. et al. . | |

OTHER PUBLICATIONS

Hellerbond New Technology for Joining Materials.
Electromagnetic Bonding of Thermoplastic.
Cookazian "Electromagnetic Bonding of Thermoplastics: Another Method of Joining Like and Unlike Plastics", Plastic Design and Processing, Sep. 1975.
Cookazian "Bonding Plastic by Induction Heating", SPE Journal Oct. 1970.
"Electromagnetic Bonding—Its Fast, Clean and Simple", Plastics World, Jul. 1970.
"Inducting Heating Activates Adhesives", Design News, Apr. 5, 1971.
Cookazian, "Induction Bonding", Modern Plastics Encyclopedia, 1971.
"Induction Heating in the Medical Field", vol. 2, No. 7, High Frequency Heating Review.

*Primary Examiner*—Donald F. Norton
*Attorney, Agent, or Firm*—Paul C. Flattery; John P. Kirby; Bradford R. L. Price

[57] ABSTRACT

A fitment for attachment to a container having an integral body constructed from a thermoplastic foam and having an integral skin outer surface and a cellular core. The body has a top and bottom surface and includes at least one resealable port.

30 Claims, 5 Drawing Figures

THERMOPLASTIC FOAM FITMENT

BACKGROUND OF INVENTION

This invention relates generally to fitments and other means for accessing containers. Specifically, the present invention relates to fitments for attachment to flexible containers and the like that house fluids to be accessed through the fitment.

In many arts, e.g., medical industry, wine industry, dairy industry, products are housed in flexible containers. For example, in the medical field, these flexible containers may contain parenteral solution, nutritional solution, peritoneal dialysis solution, or the like. An example of such a container is the VIAFLEX® collapsible plastic container for parenteral solutions sold by Travenol Laboratories, Inc. of Deerfield, Ill. The products housed within these flexible containers are accessed by an accessing member that is designed to pierce a fitment and thereby access the container. The fitment functions as an injection site or means for accessing the solution in the flexible container. To this end, the fitment includes a member that can receive a needle or other piercing means. As used herein, the term fitment includes, without limitation, ports, valves, and other means for accessing a container.

Especially in the medical field, where these fluids may be intended for intrabody administration, the fluids must be sterile at the time of use to avoid the danger of introducing harmful agents into the body. Accordingly, the container must be able to house the solution so that the solution is maintained and extracted under sterile conditions. This requires not only that the container and its contents be in a sterile sealed condition at the time of receipt by the user, but also that no contamination of the contents occur when the container is opened by a user. The problem of maintaining sterility is particularly acute at the fitment of the container where the fluid is accessed. Accordingly, the attachment of the fitment to the container may be critical.

It may also be necessary, especially in nutritional uses, that the container, and accordingly the fitment, must be punctured a plurality of times. This necessitates that the fitment has some resealability capabilities. This becomes especially acute when the gauge of the accessing needle is large and accordingly the resealability characteristics of the fitment are severely tested.

Typically, in the medical industry, resealable fitments comprise an elongated body with a port member. The port member usually encapsulates a rubber or silicone plug. The needle pierces the port through the rubber or silicone plug which because of its memory reseals the port. However, when the gauge of the needle becomes great or repeated injections are made these fitments may fail and leak.

Because these fitments are constructed from at least two separate parts the cost of these fitments and the containers produced therefrom is not optimum. Moreover, due to their construction, these prior fitments are not conducive to high speed attachment to flexible containers. Typically, these prior fitments are sealed to the container by being inserted between the webs of film that form the container, or by being inserted through a hole punched in the film. The fitment is then heat-sealed to the wall of the container. As can be seen, usually the web of film is pierced thereby violating the environment of the container.

Accordingly, there is a need for an improved fitment that overcomes the disadvantages of the prior art.

SUMMARY OF THE INVENTION

The present invention provides a fitment for attachment to a container having an integral body constructed from thermoplastic foam and having an integral skin outer surface and a cellular core. The body has a top and bottom surface and includes at least one resealable port. The bottom surface is constructed so that it is sealable to a surface of the container.

Preferably, the bottom surface is coated with an adhesive, particulate slurry, or includes a particulate gasket, that allows it to be sealed to the container. The fitment may also include a sterility sheath for covering the top surface.

Accordingly, it is an advantage of the present invention to provide a fitment that includes a resealable puncture port, and may be attached to a container without violating the container.

It is a further advantage of the present invention to provide an integral fitment.

Moreover, an advantage of the present invention is to provide a fitment with improved puncture and resealability characteristics.

Another advantage of the present invention is that it provides a fitment that can be easily secured to a filled flexible container.

A still further advantage of the present invention is that it provides a fitment that can be maintained in a sterile condition before it is secured to a container.

Additionally, an advantage of the present invention is that sterility between the container and fitment is ensured.

Another advantage of the present invention is that due to the construction of the fitment temperature uniformity is maintained throughout the fitment.

Moreover, it is an advantage of the present invention to provide a lightweight fitment.

Additionally, an advantage of the present invention is that it provides a fitment that can be attached to a container by the end user of the container.

Furthermore, an advantage of the present invention is that it provides a fitment with good gripping characteristics.

Another advantage of the present invention is that the core of the fitment has closed cells that prevent leakage during administration, even after refrigeration.

An additional advantage of the present invention is that the fitment provides a large target for the user to spike.

Additionally, an advantage of the present invention is that by controlling the cell size of the fitment you can control the gripping characteristics, sealability, and heat sink of the fitment.

A still further advantage of the present invention is that the fitment provides spike breakthrough control.

Moreover, an advantage of the present invention is that the fitment is created from foam that provides a lower modulus of flexure than a solid thermoplastic fitment.

Additionally, an advantage of the present invention is to provide a fitment that lends itself to high speed attachment to a container.

Additional features and advantages are described in, and will be apparent from, the detailed description of the presently preferred embodiments of the invention and from the drawings.

DETAILED DESCRIPTION OF THE PRESENTLY PREFERRED EMBODIMENTS OF THE INVENTION

Figure 1:
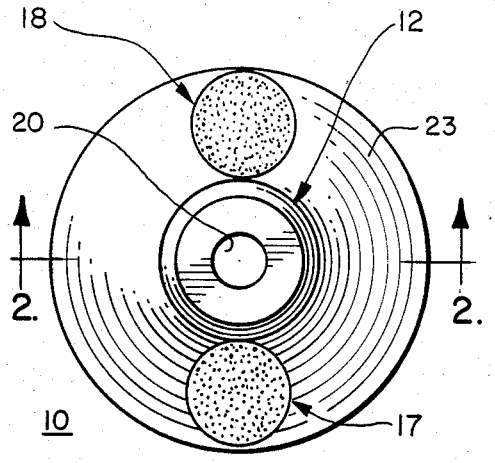
FIG. 1 illustrates a top elevational view of an embodiment of the fitment of present invention.
Figure 2:
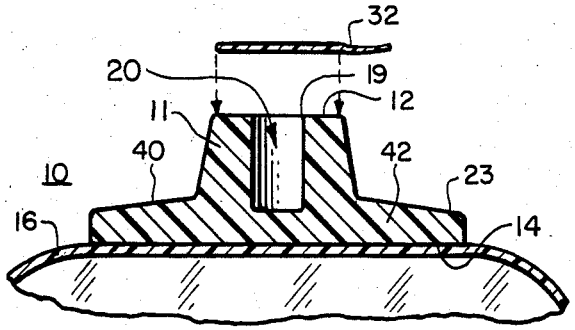
FIG. 2 illustrates a cross-sectional view of the fitment of FIG. 1 taken along lines 2—2.

Referring to FIG. 1, the fitment 10 of the present invention is illustrated. The fitment 10 includes a top surface 12 and a bottom surface 14. As illustrated in FIG. 2, the fitment 10 is designed to be sealed to a container 16. The fitment 10 provides a means for accessing the fluid or other substance housed in the container 16.

Preferably, the fitment 10 includes a resealable injection port 20 and needle puncture reseal pads 17 and 18. Of course, the fitment 10 may include more than one injection port 20 and fewer or more needle puncture reseal pads 17 and 18. As illustrated, the resealable injection port 20 includes an elongated cylindrical opening 19 that extends substantially the entire cross-sectional depth of the fitment 10. The resealable injection port 20 is designed to receive and secure a spike (not shown) that accesses the contents of the container 16. As set forth in more detail below, due to the construction of the fitment 10, the resealable port 20 has a great resealability capacity.

As previously stated, the fitment 10 also preferably includes needle puncture reseal pad 17 and 18 located on the shoulders 23 of the fitment. The reseal pads 17 and 18 are designed to allow an accessing member, e.g. needle or spike, to be inserted through the reseal pad into the container 16 and removed without the container 16 or fitment 10 leaking. The reseal pads 17 and 18 thereby provide a means for either intermittently accessing the container 16 through the fitment 10 or allows for multiple injections of additives into the container 16. Moreover, the reseal pads 17 and 18 ensures that the fluid will not drip from the fitment 10 or container 16 while the container is being accessed.

As illustrated the top 11 of the fitment 10 has a frustoconical shape. Due to the construction of the top 11 of the fitment 10 its design especially lends the fitment 10 to attachment to a flexible container through induction welding.

The top surface 12 of the fitment 10 may be protected by a removable sheath 32. Preferably, the removable sheath 32 can be placed over the top surface 12 after or before the surface has been sterilized or while the fitment 10 is being made under aseptic conditions. Accordingly, the removable sheath 32 provides a means for maintaining the sterility of the top surface 12 before the fitment 10 is to be utilized. Indeed, the top sheath 32 will most likely remain attached to the top surface 12 even after the fitment 10 is attached to the container 16 and only removed before the user desires access to the container 16.

The removable sheath 32 may comprise pressure sensitive label stock. Preferably the sheath 32 is peelable and may or may not include a pull tab. Accordingly, the removable sheath 32 may be pressure sensitive or heat sealed to the top surface 12. It has been found that a one-thousandth inch thick sheet of polyester film functions adequately as a sterile removable sheath. Although, it is preferred that the top surface 12 be covered by a removable sterile sheath 32, the bottom surface may or may not be covered by such a sheath depending on its method of attachment as set forth below.

Preferably, the fitment 10 is constructed from a thermoplastic foam and includes an outer surface 40 constructed from an integral skin and a core 42 constructed from closed cells. Preferably, the integral skin outer surface 40 has a compression load deflection ratio (CLD) of approximately 25 to about 50 psi; and the cellular core 42 has a compression load deflection ratio of approximately 5 to about 20 psi. The CLD is a measurement of the force necessary to produce a compression at 50% deflection over the entire top of the foam specimen and is determined by ASTM Test No. D3574-81 for urethanes and by ASTM test No. D3575-77 for polyethylenes. The preferred CLD for the outer layer 40 is approximately 30 to about 40 psi and the core layer 42 is approximately 5 to about 10 psi.

Preferably the fitment 10 is constructed using high pressure injection molding (United Shoe Machinery process) and a blowing agent with an elastomeric plastic material or blend thereof. The preferred blowing agents are compressed gas such as nitrogen and food contact acceptable chemical blowing agents. The elastomeric plastic materials may include: Kraton from Shell Oil Company; ethylene vinyl acetate; Santoprene from Monsanto; C-Flex from Concepts, Inc.; and Petracrh from Petrarch Systems, Inc. The elastomeric foam fitment 10 may also include an oil. The oil functions to reduce part durometer in solid form from approximately 70 Shore A to approximately 35 to about 40 Shore A. The oil must be food contact acceptable and may include vegetable or mineral oils.

Through the injection molding process the thickness of the integral skin outer surface 40 may be adjusted to provide enough flexural strength to resist leakage after puncture under pressure. Moreover, the skin thickness in combination with the closed cell structure of the core 42 provides overall reseal assurance. The preferred thickness of the skin is approximately 0.05 inches to about 0.10 inches.

It is also possible to construct the fitment 10 of the present invention through compression molding. Compression molding involves placing a blank of material in a mold, closing the mold and maintaining pressure and temperature until the material has been formed sufficiently to retain its shape after removal from the mold.

The fitment 10 of the present invention provides controllable material characteristics particularly suitable for puncture/reseal use for flexible medical or nutritional containers. Typically, these containers must be accessed by a syringe, needle, or spike. Indeed, the fitment 10 has such good resealability characteristics that it has been found that the resealable port 20, of the fitment 10, of the present invention can be spiked at least five times with at least an 18 gauge needle, without leakage. After a spike is inserted in the resealable port 20, of the fitment 10, and it is removed, the inner core 42 closes one cell at a time during the removal of the spike. This provides the fitment 10 with a uniform memory and resealable construction. Moreover, the outer surface of the skin 40 and cellular core layer 42 provide breakthrough control.

The fitment 10 of the present invention also provides a fitment that has up to approximately 50% less weight than an equivalent size fitment made from a non-foam material. Moreover, the fitment 10 gives a better tactile feel to the user. This results in better gripping characteristics for the user. By controlling the cell size one can control the gripping characteristics, sealability, and heat sink of the fitment 10.

Moreover, by varying the thickness of the outer skin 40 and the closed cells of the core 12, one can control the gauge of spikes and needles that can be accepted on a reseal basis by the fitment 10. Another advantage of the fitment 10 is a lower cost due to its lightweight which results in lower shipping costs. Moreover, in constructing the fitment 10 there are a minimum number of sink marks one normally gets during the injection molding process from shrinking. The fitment 10 of present invention also grips the spike better than prior fitments therefore ensuring that the bag does not leak during administration.

As illustrated in FIG. 2, the fitment 10 is constructed so that it can be secured to a container 16 that houses a product. Accordingly, the bottom surface 14 is constructed so that it may be secured to a wall of the container 16. Due to its construction, the fitment 10 of the present invention lends itself to line speeds that are not possible with typical form, fill, and seal machines that create containers having fitments 10.

There are a variety of ways the fitment 10 may be secured to the container 16. Copending U.S. patent application Ser. No. 802,418, filed in the names of Peter Carveth, Albert Stone and Leonard White, entitled "Apparatus and Method for Attaching Fitments to Flexible Container", discloses apparatus and methods for attaching the fitment 10 to a previously filled flexible container 16. As set forth in that application, it is possible to utilize an adhesive or solvent to bond the fitment 10 to the wall of the container 16. To this end, it is possible to coat the bottom surface 14 with the solvent or adhesive so that the fitment 10 will bond to the container 16. The method of attaching the fitment 10 to the container 16 is, to some extent, dependent on the container, the process of creating the container, whether the fitment is attached to the container after it is filled, cost, and other factors.

The fitment 10 can also be secured to the container 16 through induction bonding. Induction bonding allows the fitment 10 to be secured to a previously filled flexible container 16 or an empty container. If the fitment 10 is to be sealed to the container 16 through induction bonding, preferably the bottom surface 14 of the fitment 10 is coated with a particulate slurry or has sealed to it a gasket made from a particulate slurry. A gasket available from EMA bond, Englewood, N.J. has been found to function satisfactory; a particulate slurry available from the Bostik Division of Emhart Chemical group has also been found to function satisfactory.

The fitment 10 may also be sealed to the flexible container by a foil disc (not shown). Preferably, the foil disc comprises a one to two mil thick disc of aluminum covered by a two mil thick adhesive, e.g., a polyethylene layer on each of its sides. It has been found that foil discs available from the 3M Company or Coating Corporation of Carpentersville, Ill. function satisfactorily.

After the coating or slurry is placed on the bottom surface 14, the coating or slurry may be covered by a sterile sheath 34. However, as set forth in the co-pending application Ser. No. 802,418, the slurry or coating may be coated on the bottom surface 14 of the fitment 10 during the process of attaching the fitment 10 to the container 16.

Figure 3:
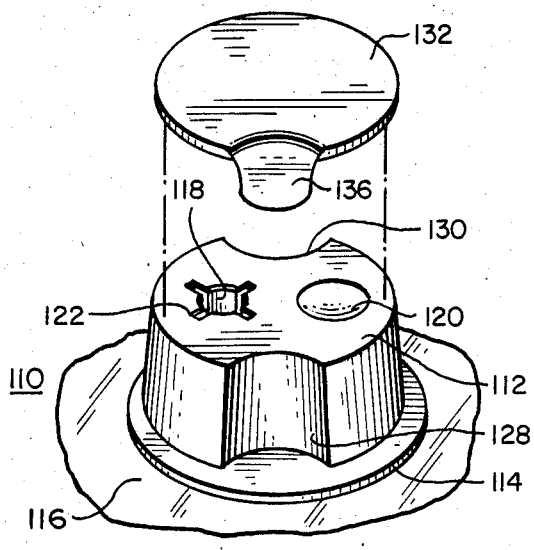
FIG. 3 illustrates another embodiment of the fitment of the present invention.

Referring to FIG. 3, another embodiment of the fitment 110 of this invention is illustrated. Preferably the fitment 110 includes a locking port 118 and resealable injection port 120. Of course, the fitment 110 may include more than one injection port 120 or locking port 118. The locking port 118 includes an elongated cylindrical opening that extends substantially the depth of the fitment 110. The locking port 118 is designed to receive and secure a spike (not shown) that accesses the contents of the container 116. To this end, the locking port 118 includes notches 122 that are designed to receive locking members on the spike and secure the spike so that it will not rotate within the locking port 118.

The fitment 110 also includes a resealable port 120. The resealable port 120 is designed to allow an accessing member, e.g. needle or spike, to be inserted through the resealable port into the container 116 and removed without the container 116 or fitment 110 leaking. The resealable port 120 thereby provides a means for either intermittently accessing the container 116 through the fitment 110 or allows for multiple injections of additives into the container 116. Moreover, the resealable port 120 ensures that the fluid will not drip from the fitment 110 or container 116 while the container is being accessed. As set forth in more detail below, due to the construction of the fitment 110, the resealable port 120 has a great resealability capacity.

The resealable port 120 has a frusto-conical shape. Of course, the resealable port 120 may be of any other shape.

As illustrated in FIG. 3, the fitment 110 includes notches 128 and 130. The notches 128 and 130 act as gripping means for the user of the fitment 110 and container 116. To this end, the notches 128 and 130 provide an area for the user's fingers to grip when inserting or removing the access means from the fitment 110 and thereby the container 116. Of course, although two notches are illustrated the fitment 110 may include more or less notches. The notches 128 and 130 may also aid in aligning the fitment 110 with the container 116 during attachment.

The top surface 112 of the fitment 110 may be protected by a removable sheath 132. Preferably, the removable sheath 132 can be placed over the top surface 112 after or before the surface has been sterilized or while the fitment 110 is being made under aseptic conditions. Accordingly, the removable sheath 132 provides a means for maintaining the sterility of the top surface 112 before the fitment 110 is to be utilized. Indeed, the top sheath 132 will most likely remain attached to the top surface 112 even after the fitment 110 is attached to the container 116 and only removed before the user desires access to the container 116.

As set forth above, preferably, the fitment 110 is constructed from a thermoplastic foam and includes an outer surface 140 constructed from an integral skin and a core (not shown) constructed from closed cells. The fitment 110 also lends itself to the high speed methods of attachment set forth above.

Figure 4:
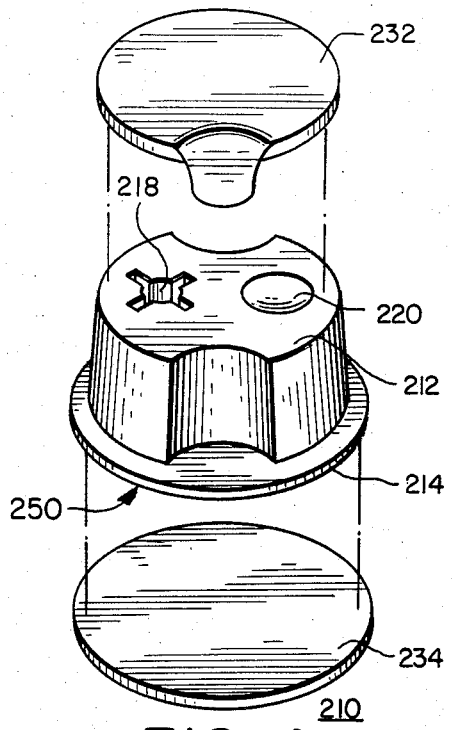
FIG. 4 illustrates an exploded view of another embodiment of the fitment of the present invention.

Although, the fitments of the present invention lends itself to high speed attachment to flexible containers in form, fill and seal apparatus, as illustrated in FIG. 4, the fitment 210 can be constructed so that it is attached to a container by the end user, e.g. doctor, nurse or patient. To this end, the bottom surface 214 includes an adhesive layer 250 that is covered by a sterile sheath 234. The end user merely removes the sterile sheath 234 and pushes the adhesive layer 250 against the flexible container 216.

The adhesive layer may comprise any adhesive layer known in the art including blends of natural and synthetic rubbers such as silicones, polyurethanes, and polyisobutylene. The adhesive may also include tackifying agent and other modifiers. The adhesive layer may also include an antimicrobial agent to ensure sterility at the connection site of the fitment 210 to the flexible container.

Figure 5:
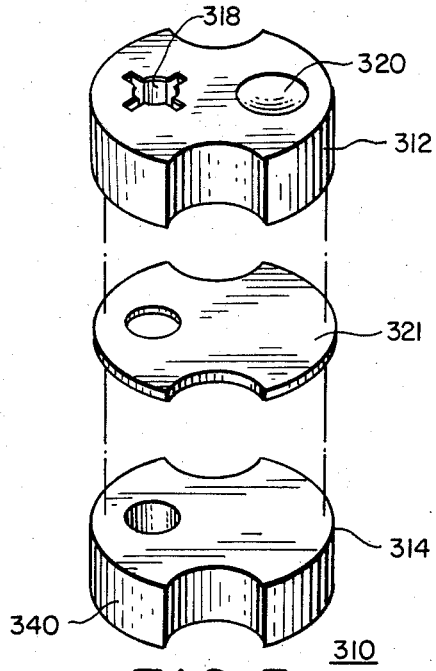
FIG. 5 illustrates an exploded view of another embodiment of the fitment of the present invention.

A further embodiment of the present invention is illustrated in FIG. 5 and comprises a fitment 310 including a top layer 312, a middle layer 321, and a bottom layer 314. The middle layer 321 is sandwiched between the top layer and bottom layer 312 and 314. Similarly to the fitment 10 previously described, the top layer and bottom layers 312 and 314 are constructed from a thermoplastic foam. Accordingly, they include an outer skin 340 and inner core (not shown) of closed cells. The middle layer 321 is constructed from a silicone, latex, melt processible rubber, or other elastomeric copolymer. The middle layer 321 provides better puncture reseal characteristics for the fitment 310. Preferably, the middle layer 321 has a cross-sectional thickness of approximately 0.03 inches to about 0.125 inches. The fitment 310 itself should have a cross-sectional width that is less than the length of the needle or spike that is to access the container.

Preferably the top layer 312, middle layer 321 and bottom layer 314 are fusion sealed together. Preferrably the top layer 312 and bottom layer 314 are constructed from a compression molding process.

As illustrated in FIG. 5, the locking port 318 has a cylindrical shape which extends through the upper, middle and bottom layers 312, 321 and 314 respectively. Preferably, the resealable port 320 is defined by an opening through the upper layer 312. Accordingly, when the spike is inserted through the resealable port 320 it will pierce the middle and lower layers 321 and 314.

The fitment 310 may also include sterile sheaths (not shown) as previously described. Moreover, the fitment 310 may be sealed to the container in a similar manner to that of the fitment 10 previously described.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A fitment comprising:

an integral body constructed from a thermoplastic foam, and having an integral skin outer surface and a cellular core;

the body having a top and bottom surface and at least one resealable port; and the bottom surface includes means for securing the bottom surface to a surface of a container.

2. The fitment of claim 1 wherein the means for securing includes a particulate slurry layer on the bottom surface.

3. The fitment of claim 1 wherein the body includes a locking spike port.

4. The fitment of claim 1 including means for insuring the sterility of the top surface.

5. The fitment of claim 1 wherein the top surface includes at least one reseal pad.

6. The fitment of claim 1 wherein the body includes a portion having a frusto-conical shape.

7. The fitment of claim 1 wherein the body includes gripping means for gripping the fitment after it is attached to a container.

8. A fitment comprising:

an integral body constructed from a thermoplastic foam, and having an integral skin outer surface and a cellular core;

the body having a top and bottom surface and at least one resealable port; and the bottom surface including means for securing the bottom surface to a surface of a container, the means for securing includes an adhesive layer on the bottom surface.

9. A fitment comprising:

an integral body constructed from a thermoplastic foam, and having an integral skin outer surface and a cellular core;

the body having a top and bottom surface and at least one resealable port; and means for insuring the sterility of the top surface, wherein said means for insuring the sterility includes a peelable sheath.

10. A fitment for attachment to a container comprising:

a body having an outer surface having an integral skin and an inner core having closed cells;

the body including a top and bottom surface and having at least one resealable port; and the bottom surface including means for sealing the fitment to the container without violating the environment of the container.

11. The fitment of claim 10 wherein the means for sealing the fitment is a particulate slurry.

12. The fitment of claim 10 wherein the means for sealing the fitment is a gasket constructed from a particulate slurry.

13. The fitment of claim 10 wherein the body is constructed from a thermoplastic foam.

14. The fitment of claim 10 wherein the means for sealing is an adhesive layer.

15. The fitment of claim 14 wherein the adhesive layer is covered by a peelable sheath.

16. The fitment of claim 10 wherein the thermoplastic foam is chosen from the group consisting of Kraton, ethylene vinyl acetate, or Santoprene.

17. The fitment of claim 10 wherein said outer surface has a compression load deflection ratio of between approximately 25 to about 50 psi and the inner core has a compression load deflection ratio of between approximately 5 to about 20 psi.

18. The fitment of claim 10 including a peelable sheath for covering the top surface.

19. A fitment for attachment to a container comprising:

an upper layer having an integral skin and closed cellular core;

a middle layer constructed from an elastomeric member;

a lower layer having an integral skin and closed cellular core; and the lower and upper layer sandwiching the middle layer therebetween.

20. The fitment of claim 19 wherein:

the lower layer includes means for securing the fitment to the container; and the upper layer includes at least one resealable port.

21. The fitment of claim 20 wherein the fitment can be attached to the container without violating the environment of the container.

22. The fitment of claim 19 wherein the upper, middle, and lower layers are fusion sealed together.

23. The fitment of claim 19 wherein the middle layer is constructed from a material chosen from the group consisting of, latex silicone, or melt processible rubber.

24. The fitment of claim 19 including at least one resealable port.

25. The fitment of claim 19 including at least one locking port.

26. The fitment of claim 19 wherein the means for securing the fitment to the container is a particulate slurry.

27. The fitment of claim 19 wherein the means for securing is a gasket constructed from a particulate slurry.

28. A fitment for attachment to a container comprising:

an upper layer having an integral skin and closed cellular core;

a middle layer constructed from an elastomeric member;

a lower layer having an integral skin and closed cellular core;

the lower and upper layer sandwiching the middle layer therebetween; and the upper layer is covered by a peelable sheath.

29. A fitment for attachment to a container comprising:

an upper layer having an integral skin and closed cellular core;

a middle layer constructed from an elastomeric member;

a lower layer having an integral skin and closed cellular core;

the lower and upper layer sandwiching the middle layer therebetween;

the lower layer includes means for securing the fitment to the container the means for securing including an adhesive layer; and the upper layer includes at least one resealable port.

30. The fitment of claim 29 wherein the adhesive layer is covered by a peelable sheath.

* * * * *